US005327859A

United States Patent [19]

Pierik et al.

[11] Patent Number: 5,327,859

[45] Date of Patent: Jul. 12, 1994

[54] ENGINE TIMING DRIVE WITH FIXED AND VARIABLE PHASING

[75] Inventors: Ronald J. Pierik, Rochester; James O. Wilson, Perry, both of N.Y.

[73] Assignee: General Motors Corporation, Detroit, Mich.

[21] Appl. No.: 74,439

[22] Filed: Jun. 9, 1993

[51] Int. Cl.[5] ..... F01L 1/04; F01L 1/34

[52] U.S. Cl. ..... 123/90.17; 123/90.31; 123/192.2

[58] Field of Search ..... 123/90.15, 90.17, 90.31, 123/192.2

[56] References Cited

U.S. PATENT DOCUMENTS

| | | | |
|---|---|---|---|
| 1,220,124 | 3/1917 | Hoffner | 123/146.5 R |
| 1,358,186 | 11/1920 | Brewer | 123/90.15 |
| 1,460,405 | 7/1923 | Brewer | 74/395 |
| 4,294,218 | 10/1981 | King et al. | 123/502 |
| 4,305,352 | 12/1981 | Oshima et al. | 123/90.15 |
| 4,583,501 | 4/1986 | Williams | 123/90.15 |
| 4,714,057 | 12/1987 | Wichart | 123/90.15 |
| 4,747,375 | 5/1988 | Williams | 123/90.15 |
| 4,856,370 | 8/1989 | Stidworthy | 74/675 |
| 4,986,801 | 1/1991 | Ohlendorf et al. | 475/331 |
| 4,993,370 | 2/1991 | Hashiyama et al. | 123/90.31 |
| 5,144,921 | 9/1992 | Clos et al. | 123/90.17 |
| 5,174,253 | 12/1992 | Yamazaki et al. | 123/90.31 |
| 5,181,485 | 1/1993 | Hirose et al. | 123/90.31 |
| 5,203,291 | 4/1993 | Suga et al. | 123/90.31 |

OTHER PUBLICATIONS

Research Disclosure-14639-Jun. 1976-Stratified Charge or Jet Ignition Engine with Mechanism for Varying the Relative Timing of the Main and Auxiliary Inlet Valves.

*Primary Examiner*—E. Rollins Cross
*Assistant Examiner*—Weilun Lo
*Attorney, Agent, or Firm*—C. K. Veenstra

[57] ABSTRACT

An engine timing drive for driving a camshaft and an accessory such as a balance shaft has a transmission member including a fixed phase output for driving the accessory and a variable phase output for driving the camshaft. A preferred embodiment incorporates a planetary cam phaser in a driven sprocket that also carries a fixed phase output gear as an accessory drive.

9 Claims, 2 Drawing Sheets

ENGINE TIMING DRIVE WITH FIXED AND VARIABLE PHASING

TECHNICAL FIELD

This invention relates to engine timing drives and in particular to camshaft drives wherein means are provided to vary the phase angle between the camshaft and crankshaft.

BACKGROUND

It is known in the art relating to camshaft drives and the like to provide a variable timing means or phase changer to vary the angular orientation or phase of a camshaft relative to the crankshaft by which it is driven at a nominally fixed ratio, ½ crankshaft speed in four stroke cycle engines. The phase variation may be used for various purposes, such as to vary the valve timing to improve engine performance, economy or emission control.

It is also known in some engines to use the crankshaft or its drive to in turn drive other timed or non-timed accessories or devices, such as an ignition distributor, injection pump, oil pump or a balance shaft. In the latter case, at least, it is necessary to maintain a fixed speed ratio, such as 1:1 or 2:1, and a fixed phase angle between the crankshaft and the balance shaft so that desired engine balance may be maintained.

In a current engine having such a fixed ratio camshaft and balance shaft drive with a 1:1 balance shaft speed ratio, it was desired to provide means for varying camshaft phasing without altering the fixed drive ratio and phasing of the balance shaft which is driven by the camshaft drive. The resulting drive was to preferably require minimal change in the current drive arrangement and associated components.

SUMMARY OF THE INVENTION

The present invention provides a variable phase or timing drive for driving a camshaft or other component at a fixed ratio with variable phase or timing change capability while driving in turn an accessory or other component at a fixed ratio and phase relationship.

In a preferred embodiment, the drive connects the crankshaft of an engine with the camshaft and a balance shaft for driving the camshaft at a nominal first ratio of ½ crankshaft speed and in turn driving the balance shaft at a fixed second ratio of 2/1 relative to camshaft speed (1/1 relative to crankshaft speed). A phase changer incorporated in the drive allows variation of the camshaft timing without change in phasing of the balance shaft relative to the crankshaft. The timing mechanism approximates the overall arrangement and location of the non-variable drive, thus requiring minimal changes in associated components.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
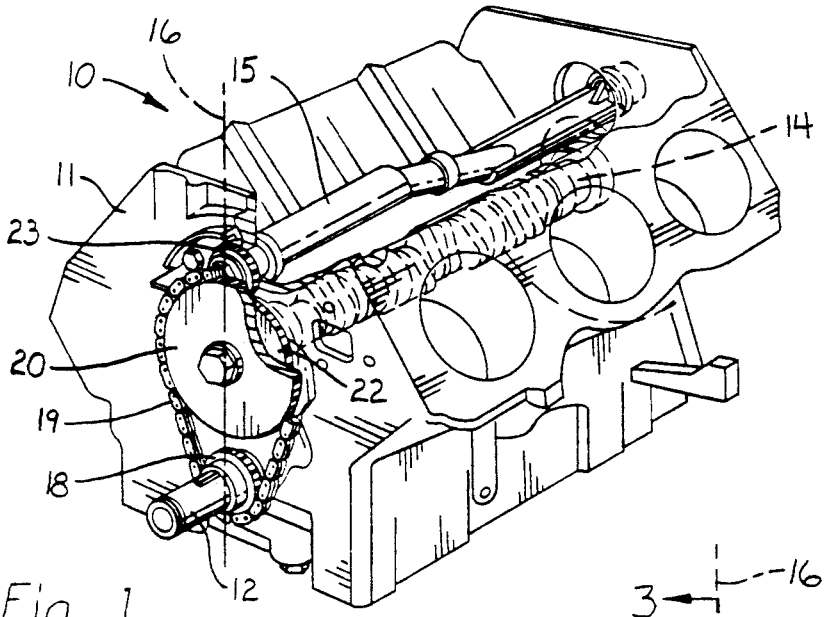
Fig. 1 PRIOR ART
FIG. 1 is a pictorial view partially broken away to illustrate a V-6 engine having a known prior art cam and balance shaft drive arrangement.

Referring now to the drawings in detail, FIG. 1 illustrates a prior art four stroke cycle 90° V-6 internal combustion engine 10 of a type in current use in automotive vehicles. The engine 10 includes a cylinder block 11 rotatably supporting a crankshaft 12, a camshaft 14 and a balance shaft 15 mounted on parallel axes upwardly aligned along the central vertical plane 16 of the engine.

At the front end of the engine, the crankshaft 12 carries a driving sprocket 18 that is connected by a chain 19 to a driven sprocket 20 mounted on the camshaft 14. The ratio of this connection is 1:2 so that the camshaft is driven at half the crankshaft speed. Behind the driven sprocket, the camshaft 14 carries a drive gear 22 that directly engages a driven gear 23 mounted on the balance shaft 15. The ratio of this connection is 2:1 so that the camshaft drives the balance shaft at twice camshaft speed, which is at the same speed as and in time with the crankshaft. The balance shaft creates a rotating couple timed with the crankshaft rotation to partially offset the natural unbalance of the 90° V-6 engine components.

Figure 2:
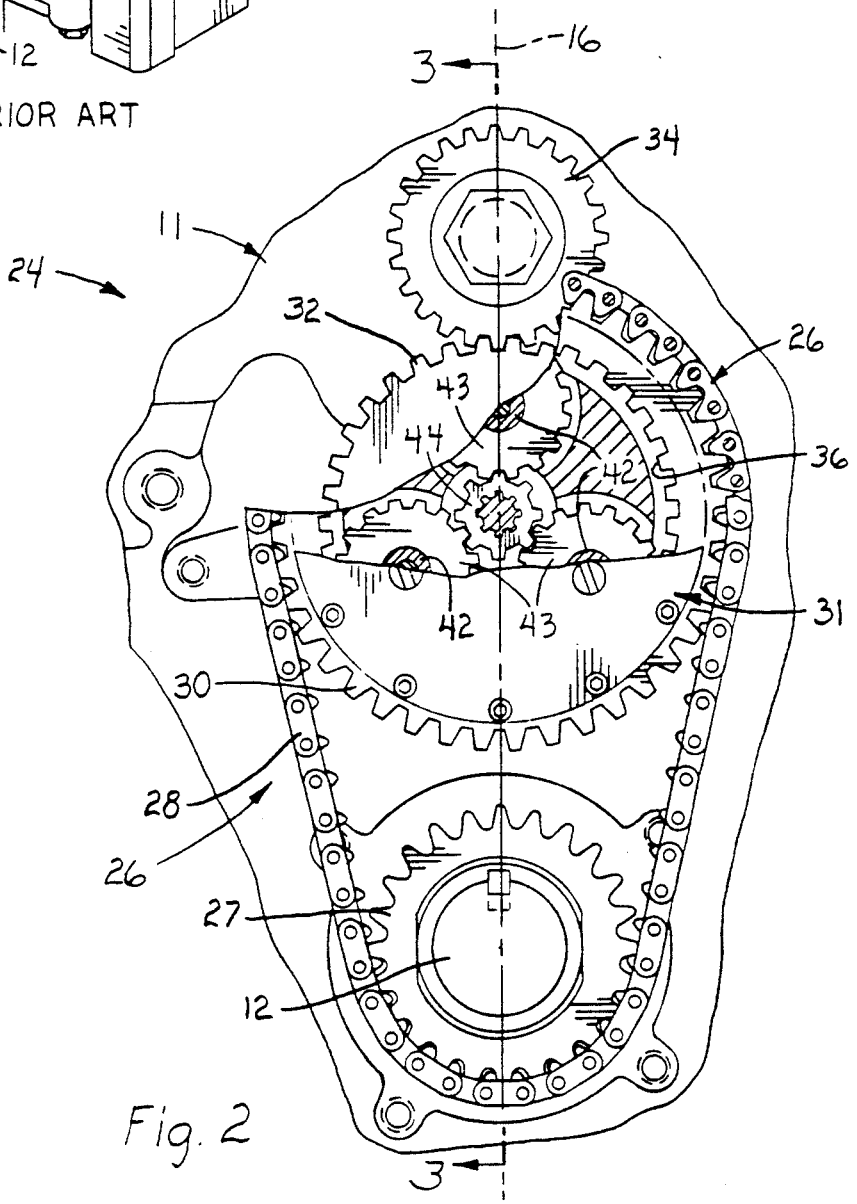
FIG. 2 is an end view of an engine with variable timing drive according to the invention and having portions broken away to reveal hidden components.
Figure 3:
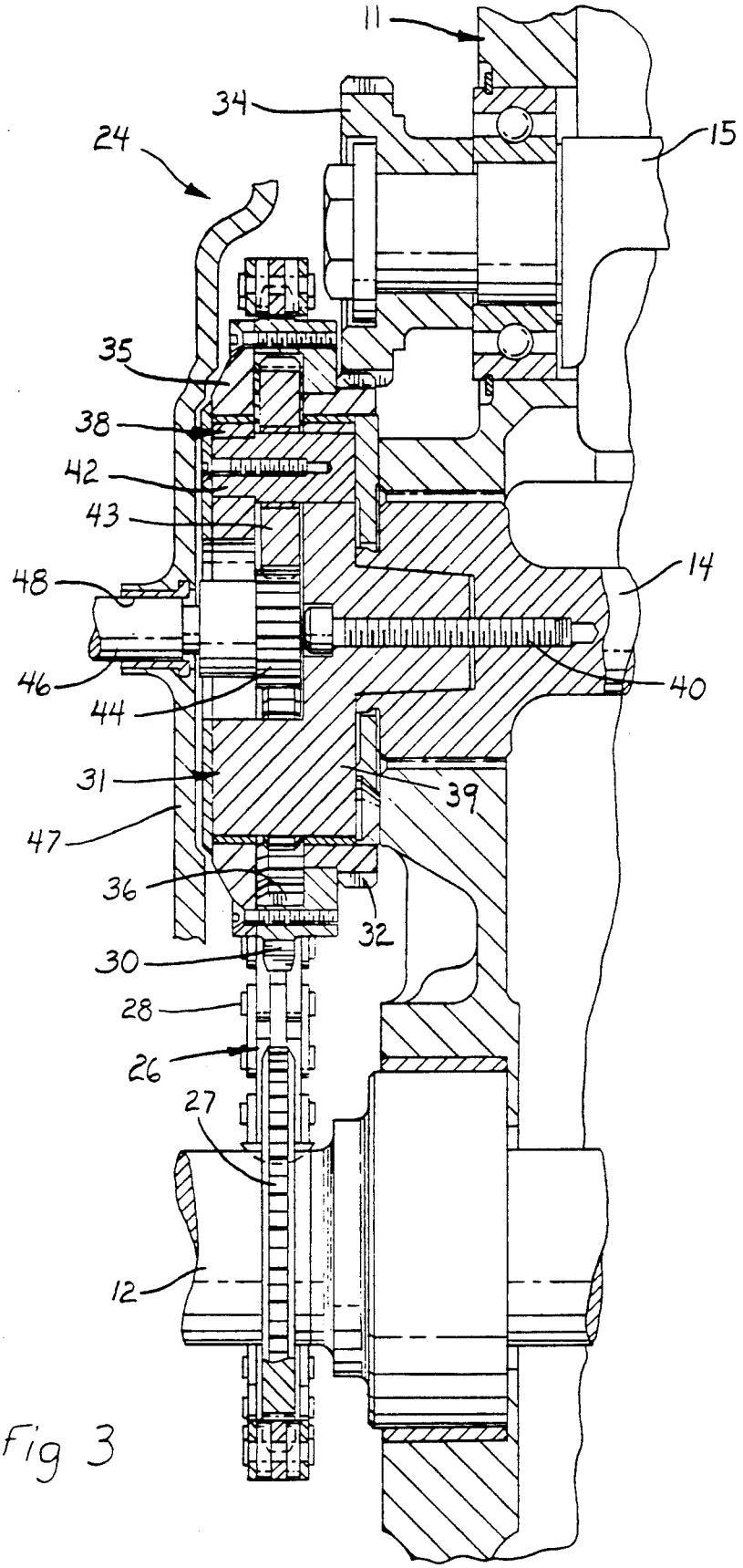
FIG. 3 is a longitudinal cross-sectional view from the central plane indicated by the line 3—3 of FIG. 2.

FIGS. 2 and 3 illustrate portions of a V-6 engine 24 similar to engine 10 but having a variable timing drive 26 according to the invention that permits adjusting the phase angle of the camshaft relative to the crankshaft during operation of the engine. The cylinder block 11, crankshaft 12, camshaft 14 and balance shaft 15 of the engine 24 may be the same as in the prior engine 10 although changes could be made in these items if desired.

Timing drive 26, in the preferred embodiment illustrated, includes a drive sprocket 27 mounted on the front end of the crankshaft, and connected by a chain 28 to a driven sprocket 30 rotatable on the camshaft axis. The driven sprocket forms part of a planetary phase changer 31 that is mounted on the camshaft 14 as will be subsequently more fully described.

A drive gear 32, rotatable on the camshaft axis and also forming part of the phase changer 31, is directly connected with the driven sprocket 30 for rotation therewith. The drive gear 32 directly engages a driven gear 34 mounted on the balance shaft 15 and completes a drive train for driving the balance shaft in phase with the crankshaft at the same rotational speed.

The phase changer 31 includes the driven sprocket 30 and the drive gear 32 connected together with a bearing ring 35 to form an outer assembly. A ring gear 36 of a planetary gear set is also fixed inside of the driven sprocket for rotation therewith. The outer assembly 30, 32, 35, 36 is rotatably supported by bearings on a planet carrier 38. The carrier includes a drive flange 39 fixed by a screw 40 to the camshaft 14 and carrying three stubshafts 42 each rotatably supporting a planet gear 43. The planet gears 43 engage the ring gear 36 and a central floating sun gear 44. A control shaft 46 connects the sun gear 44 with external control means, not shown, for adjusting the angular position of the sun gear. The shaft 46 may be made removable from the sun gear 44 and may be supported in an outer cover 47 by a bearing 48.

Many combinations of gear and sprocket tooth numbers could be chosen for obtaining the desired drive ratios and operation to be described. In the illustrated embodiment, selected values were chosen as suitable for the particular load and dimensional constraints involved. The selected tooth numbers are as follows:

| | |
|---|---|
| Drive/driven sprocket | = 24/40 |
| Drive/driven gear | = 65/39 |
| Ring/planet/sun gears | = 70/28/14 |

In operation of the engine 24, rotation of the crankshaft 12 rotates the drive sprocket 27, causing the driven sprocket 30 to rotate at a speed with a 3:5 ratio or 0.6 times the speed of the crankshaft. The drive gear 32 is rotated at the speed of the connected driven sprocket 30 and in turn drives the driven gear with a 5:3 ratio to turn the balance shaft at 1⅔ times the speed of the drive gear, which is the same speed as and in fixed phase 1:1 timing with the crankshaft. This result is the same as in the prior engine drive but with differing intermediate drive ratios.

The driven sprocket also turns the ring gear 36 at a speed 0.6 times crankshaft speed. With the sun gear held stationary, the ring gear drives the planet carrier 38 through the planet gears 43 at a ratio of 5:6 or 5/6 times the speed of the driven sprocket. This results in a camshaft speed equal to the carrier speed of 5/6 times 0.6 or ½ the speed of the crankshaft as in the prior engine drive. An advantage of this choice of ratios is that the outer assembly including the driven sprocket 30 moves continuously on its bearings relative to the planet carrier 38 by which it is supported but at a low relative speed of only 1/10 the speed of the crankshaft. Thus continuous lubrication of the sliding surfaces is maintained but the loss in friction is kept low while the nonstationary condition of the surfaces avoids the possibility of the parts sticking together to make phase changing difficult.

Changing of the angular relation or phase of the camshaft relative to the crankshaft is accomplished easily by adjusting the rotational position of the control shaft 46 via any suitable external means. In use, the possible extent of the phase change is limited to stay within the range of desired or practical engine operating conditions.

The illustrated timing drive provides a particularly effective and compact phase varying camshaft and balancer drive for a particular engine arrangement. The concepts may be more generally applied in other related applications where a camshaft or other output for which variable phase adjustment is desired is driven from a common source with another component or accessory which requires fixed phase relation with the driving source. Thus, while the invention has been described by reference to a preferred embodiment, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A timing drive for an engine camshaft and an accessory both timed with a driving crankshaft and all having parallel axes wherein the drive provides variable phasing of the camshaft and constant phase driving of the accessory, said timing drive comprising a drive sprocket drivably connected with the crankshaft for rotation with the crankshaft on the crankshaft axis, a driven sprocket mounted for rotation on the camshaft axis and drivably connected with the drive sprocket to be driven thereby at a first drive ratio, a drive gear connected with the driven sprocket for rotation therewith on the camshaft axis, a driven gear drivably connected with the accessory for rotation on the accessory axis and drivably connected with the drive gear to be driven thereby at a second drive ratio, and a planetary drive train drivably connected between the driven sprocket and the camshaft for driving the camshaft at a third drive ratio, the planetary drive train including a ring gear connected with the driven sprocket for rotation therewith on the camshaft axis, a carrier connected with the camshaft for rotation therewith on the camshaft axis, and a plurality of planet gears rotatably supported by the carrier, the planet gears engaging the ring gear to thereby drive the carrier and the camshaft, the carrier further rotatably supporting the drive gear, the driven sprocket and the ring gear, the planetary drive train further including a sun gear coaxial with the ring gear and engaging the planet gears, the rotative position of the sun gear being adjustable to vary the phasing of the camshaft relative to the crankshaft.

2. A timing drive as in claim 1 wherein the accessory is a balance shaft.

3. The invention as in claim 2 wherein the product of the first and second ratios is a whole number not exceeding 2.

4. The invention as in claim 2 wherein the second ratio is the inverse of the first ratio.

5. The invention as in claim 4 wherein the first ratio is in a range of from 0.55/1–0.75/1.

6. The invention as in claim 2 wherein the product of the first and third ratios is ½.

7. The invention as in claim 2 wherein the drive and driven sprockets are connected by a chain and the first drive ratio is 3/5, the second drive ratio is 5/3, and the third drive ratio is 5/6.

8. The invention as in claim 7 wherein the differential speed ratio of the drive gear, the driven sprocket and the ring gear relative to the carrier is less than 0.15.

9. The invention as in claim 8 wherein said differential ratio is 0.1.

* * * * *